US010308391B1

(12) United States Patent
Greene

(10) Patent No.: US 10,308,391 B1
(45) Date of Patent: Jun. 4, 2019

(54) CONTAINER AND STAND FOR A PORTABLE DEVICE

(71) Applicant: Stanley Ewing Greene, Dallas, TX (US)

(72) Inventor: Stanley Ewing Greene, Dallas, TX (US)

( * ) Notice: Subject to any disclaimer, the term of this patent is extended or adjusted under 35 U.S.C. 154(b) by 0 days.

(21) Appl. No.: 13/840,903

(22) Filed: Mar. 15, 2013

(51) Int. Cl.
*B65D 5/42* (2006.01)

(52) U.S. Cl.
CPC ..... *B65D 5/42* (2013.01)

(58) Field of Classification Search
CPC ... B65D 5/308; B65D 27/22; A45C 2011/003; A45C 3/02; A45C 13/02; A45F 2200/0525; A45F 2200/0516; G06F 1/1628
USPC ..... 206/45.2, 320, 464, 465; 220/628, 756, 220/770
See application file for complete search history.

(56) References Cited

U.S. PATENT DOCUMENTS 2,005,027 A * 6/1935 Ellsworth ..... 229/147
2,542,180 A * 2/1951 Chemlinski ..... 206/45.2
3,195,850 A * 7/1965 Steiner ..... 248/454
4,149,630 A * 4/1979 Transport ..... 206/45.24
4,479,318 A * 10/1984 Russell ..... 40/788
4,708,239 A * 11/1987 Bourbon ..... 206/45.23
4,895,295 A * 1/1990 Montgomery et al. ..... 294/165
5,016,814 A * 5/1991 Fullerton ..... 229/196
5,398,893 A 3/1995 Barker
8,235,208 B2 * 8/2012 Sirichai et al. ..... 206/320
8,281,924 B2 * 10/2012 Westrup ..... 206/320
2010/0294683 A1 * 11/2010 Mish ..... A45C 11/00 206/320
2011/0247959 A1 * 10/2011 Nelson ..... 206/525
2011/0315594 A1 * 12/2011 Sielski ..... B65D 5/003 206/557
2012/0043234 A1 * 2/2012 Westrup ..... 206/320
2013/0048514 A1 * 2/2013 Corcoran et al. ..... 206/45.23

* cited by examiner

*Primary Examiner* — Anthony D Stashick
*Assistant Examiner* — James M Van Buskirk
(74) *Attorney, Agent, or Firm* — Papalas PLLC

(57) ABSTRACT

Embodiment describe a container for a device that has two functional modes. In the first mode, the container holds the device for transport. In the second mode, the container acts as a stand for the device and holds the device for use by a user. In one embodiment, the container is made from recycled materials.

9 Claims, 8 Drawing Sheets

CONTAINER AND STAND FOR A PORTABLE DEVICE

TECHNICAL FIELD

A container and stand for a portable device and methods of making and use are provided.

BACKGROUND

Recycling is a process using waste materials to form new products. Recycling prevents waste of new materials, and reduces the consumption of fresh raw materials, as recycling uses discarded or otherwise used materials to form the new products. Recycling may also reduce energy and water usage in the formation of materials from raw ingredients. Recycling also reduces pollution by preventing the disposal of the materials. For example, recycling reduces air pollution from incineration, and land and water pollution from land filling. Recycling is a key component of modern waste reduction and is the third component of the "Reduce, Reuse, Recycle" waste hierarchy.

SUMMARY

According to one embodiment, a container that has two arrangements, wherein in a first arrangement, the container holds a portable device for transport, and wherein a second arrangement, the container supports the portable device in a position for use of the device, the container comprises: a first pocket that holds a first corner of the device; a second pocket that holds a second corner of the device; a first retaining strap that holds a third corner of the device; a second retaining strap that holds a fourth corner of the device; a device surface that adjoins the device and holds the device in the two arrangements, wherein the device surface is connected to the first pocket, the second pocket, the first retaining strap, and the second retaining strap; a device support surface that adjoins the device surface, wherein the device support surface is parallel to the device surface in the first arrangement, and wherein the device support surface is at a nonzero angle with the device surface in the second arrangement; an interface support surface that is adjacent to the device support surface, wherein the device support surface is parallel to the device surface in the first arrangement, and wherein the interface support surface is at a nonzero angle with the device surface in the second arrangement; wherein the device surface, the device support surface and the interface surface form a polygon in one view of the second arrangement.

According to another embodiment, a method of using a container that has two functional modes, the method comprising: attaching a device to the container; manipulating at least two features of the container to place the container in the first functional mode, wherein the first functional mode is transporting the device; and manipulating at least two features of the container to place the container in the second functional mode, wherein the second functional mode is presenting the device for use by a user.

BRIEF DESCRIPTION OF THE FIGURES

The features and advantages of certain embodiments will be more readily appreciated when considered in conjunction with the accompanying figures. The figures are not to be construed as limiting any of the preferred embodiments.

DETAILED DESCRIPTION OF THE INVENTION

Figure 1:
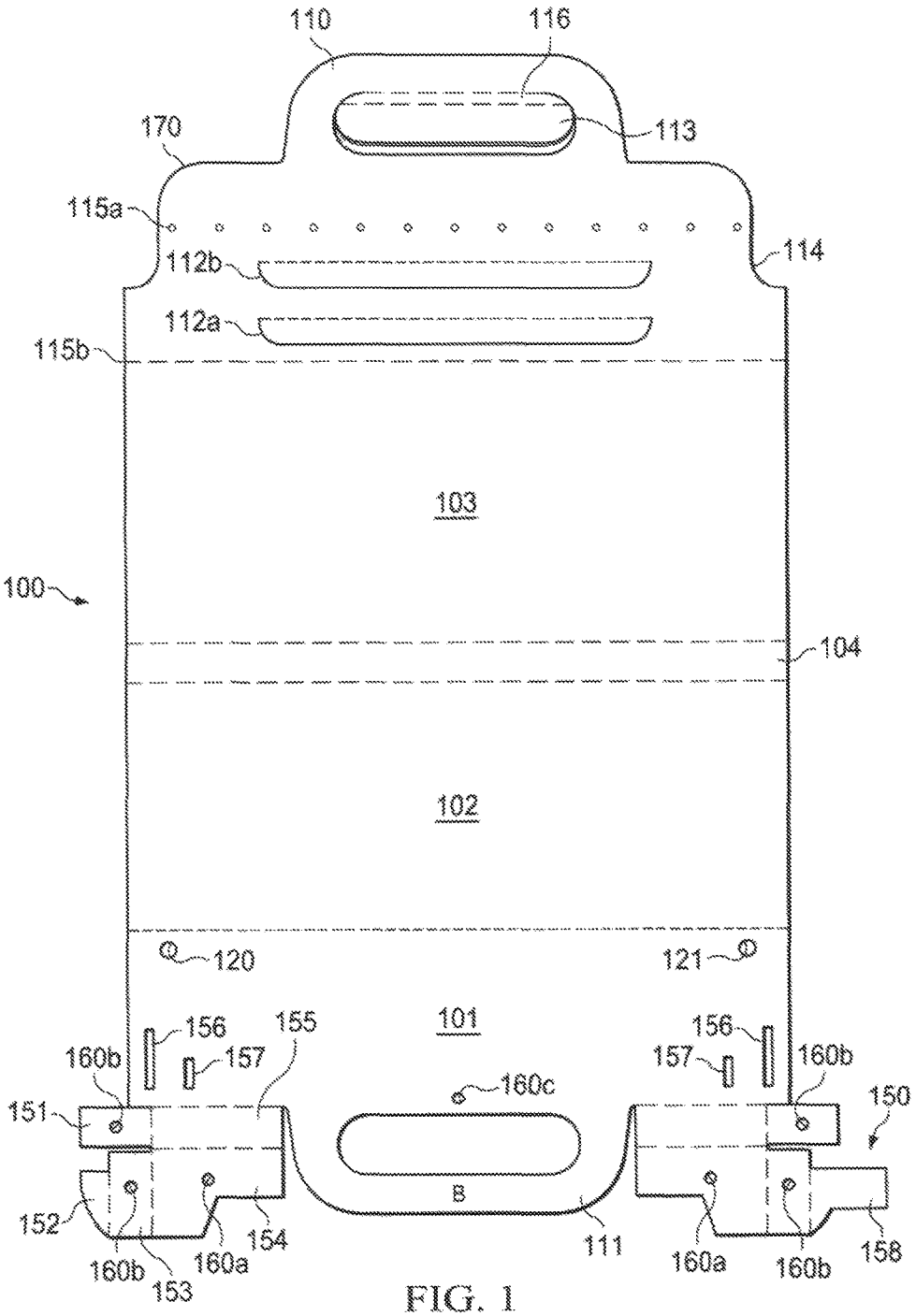
FIG. 1 depicts an example of the container and stand for a device.

The invention now will be described more fully hereinafter with reference to the accompanying drawings. This invention may, however, be embodied in many different forms and should not be construed as limited to the embodiments set forth herein. Rather, these embodiments are provided so that this disclosure will be thorough and complete, and will fully convey the scope of the invention to those skilled in the art. One skilled in the art may be able to use the various embodiments of the invention The container described herein serves two main functions, as expressed in two arrangements. The first function is to hold or contain a device. As used herein, the device may be an electronic device, a portable electronic device, a computer device, a display screen, an image projector, an IPAD, a notebook computer, an MP3 player, a personal data assistant, a cellular telephone, a camera, and a smart phone. The device may also be a non-electronic device, such as marker board, chalk board, a paper tablet, and the container would function as a binder. The container described herein may be resized as needed to accommodate different sized devices. In this first arrangement, the container protects the device by covering the screen of the device and padding the device during transport of the device. The second function of the container is to act as a stand for the device. In this second arrangement, the container supports the device in a position that allows the device to be used by a user. The container maintains a removable attachment with the device while the container is in the first function mode, the second function mode, and the transition between the first function mode and the second function mode.

The container described herein is preferably made from materials that have been used for other purposes. Thus, the container described herein is preferably made from recycled materials.

One example of such a material is cardboard. The cardboard may be a portion of the packaging for the device. The cardboard may be packaging from other products, such as the cardboard backing from note pads. The cardboard should have sufficient strength to support the device. The cardboard is preferably made of one piece that is sized to accommodate the device. The cardboard may be corrugated or non-corrugated. It is preferable that the cardboard be corrugated for the container and be oriented such that the internal corrugation of the cardboard is perpendicular to the major structural folds, e.g. the fold between the device bottom surface (104 of FIG. 1) and the device support surface (102 of FIG. 1), and the fold between the device bottom surface (104 of FIG. 1) and the interface support surface (103 of FIG. 1). Note that the cardboard material may be coated with a water resistant material and/or reinforcing material, e.g. spray rubber or plastic coating, to provide some weather protection for the device and/or improve the durability of the container.

Another example of such a material is corrugated plastic. One example of corrugated plastic is polypropylene plastic or PP plastic and is typically marked with the recycling number 5. Polypropylene is desirable because the plastic is resistant to fatigue, and thus can be bent or folded multiple times without breaking. Note that other plastics may be used. The corrugated plastic may be a portion of the packaging for the device. The corrugated plastic may be packaging from other products, or from other sources such as a yard sign, e.g. political signs, real estate signs. The corrugated plastic should have sufficient strength to support the device. Corrugated plastic has two common thickness sizes, 2 and 4 millimeters. The 2 millimeter thick plastic has corrugation chambers that are 2 millimeters thick and about 3 millimeters in length. The 4 millimeter thick plastic has corrugation chambers that are 4 millimeters thick and about 5.5 millimeters in length. The corrugated plastic is preferably made of one piece that is sized to accommodate the device. It is preferable that corrugated plastic for the container be oriented such that the internal corrugation of the plastic is parallel with the major structural folds, e.g. the fold between the device bottom surface (104 of FIG. 1) and the device support surface (102 of FIG. 1), and the fold between the device bottom surface (104 of FIG. 1) and the interface support surface (103 of FIG. 1). Note that if corrugated plastic is used, then to make the various cuts for the container may require additional material to be removed to form cavities instead of only cutting plastic. Further note, that to make folds, the corrugated plastic may have to be cut on the opposite side to allow for the folding to occur.

FIG. 1 depicts an example of the container and stand 100 for a device. The container may be formed by using a one or more die(s) in a press to cut the pattern. The various peak and valley folds may also be formed by one or more die(s) in a press. Alternatively, a pattern for the container may be traced or printed onto a piece of material, and the various cuts and folds may be made by hand.

Note that in this view of the container 100, the device would be placed onto surface 101 and 102 with the valley and peak folds as shown. If the container 100 were to be flipped over, then the valley and peak folds would be reversed.

The container 100 includes surface 101, which is the device surface 101. The device would be removably attached to this surface. In the orientation of the container 100 of FIG. 1, the device would be placed with its user interface(s), e.g. screen, keyboard, and/or point device, facing outward and with the top oriented toward handle 110 and the bottom oriented toward stand handle 111.

The device may be attached to the device surface 101 with an adhesive, such as glue or double sided tape. Alternatively, the device may attached to the device surface 101 by one or more retaining straps 130 of FIG. 2. For example, two straps 130 may be used. The first strap being passed through the first retaining strap hole 120 and looped around an opposite, upper corner of the device. More specifically, with hole 120 located on the left side of the container, the strap 130 passing through hole 120 would loop around the right upper corner of the device. The second strap being passed through the second retaining strap hole 121 and looped around an opposite, upper corner of the device. More specifically, with hole 121 located on the right side of the container, the strap 130 passing through hole 121 would loop around the left upper corner of the device. Note that this cross loop arrangement is by way of example only, as other arrangement could be used. For example, each strap could loop around the same-side, upper corner of the device.

The strap 130 includes dowel 131 and connector 132. The dowel 131 prevents the strap from being pulled through the hole 120, 121. Optionally, the dowel may be glued or taped to the exterior surface, which is the surface opposite to the surface that interfaces with the device. The strap 130 may be comprised of a rubber band, elastic band, and/or hair band. The dowel 131 may be comprised of a wood or metal, and may be a fastener, a pin, a paperclip, or a nail. The dowel may also be fitted into a cavity (not shown) made in the exterior of device surface 101. The cavity would correspond with the corrugation, and thus the dowel would be mounted flush with the exterior of the device surface 101. The connector 132 connects the dowel 131 with the strap 130. The connector may comprise a knot that is formed in the strap 130 around the dowel 131.

Figure 2:
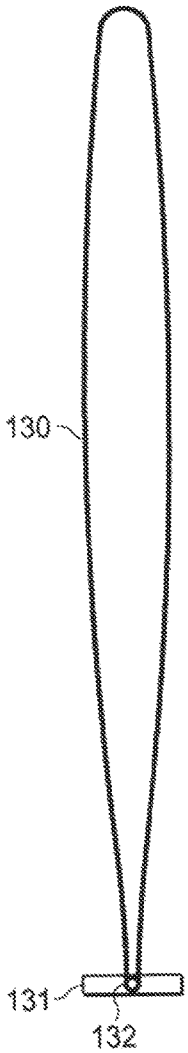
FIG. 2 depicts an example of a retaining strap for use with the container of FIG. 1.

Alternatively, the device may be attached to the device surface 101 by one retaining strap 130 of FIG. 2. The strap is passed through a single retaining strap hole (not shown) that is located in the center of the container, e.g. at location between holes 120 and 121. The strap is then looped around both upper corners of the device. However, in this arrangement, the strap 130 may block a portion of the interface, e.g. screen, of the device.

The device surface includes one or more pockets 150. In the embodiment shown in FIG. 1, the container has two pockets 150. Each pocket is formed by folding the various surfaces and engaging the tab and slot as follows. The pocket outer front surface 154 and the pocket bottom surface 155 are folded so that the pocket outer front surface 154 is parallel with the device surface 101 and the pocket bottom surface 155 is perpendicular with the device surface 101. The pocket flap 151 is then folded into the region created by the outer front surface 154 and the device surface 101. The pocket outer side surface 153 is then folded down with the pocket tab 152 being inserted into pocket slot 156. The pocket tab 152 may be fixed in place on the device surface 101 with an adhesive or tape, or if the material of the container is plastic, the tab 152 may be heat-sealed to the surface 101.

Figure 3A:
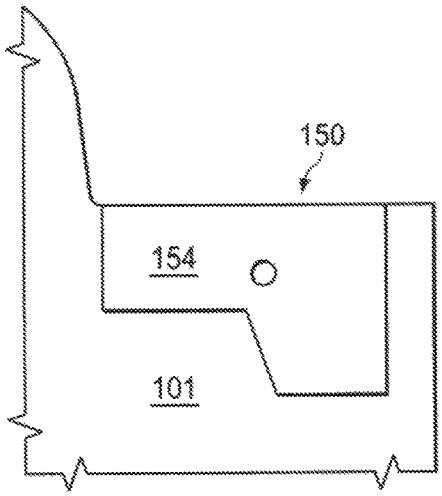
FIGS. 3A-3C depict an example of a finished pocket 150 of the container of FIG. 1.
Figure 3B:
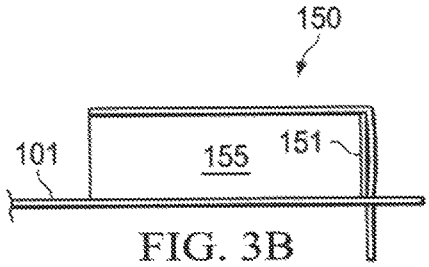
Figure 3C:
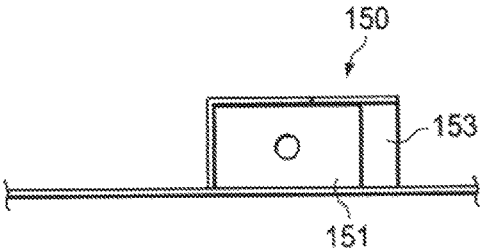

An example of a finished pocket 150 is shown in FIGS. 3A-3C. FIG. 3A depicts a top external view of pocket 150. FIG. 3B depicts an internal view of the front of the pocket 150. FIG. 3C depicts an internal side view of the pocket 150. Each pocket would receive a respective bottom corner of the device.

Alternatively, the pocket tab 152 may have an elongated portion such at the pocket tab 158. This type of tab 158 may be passed through pocket slot 156 and then passed through elongated slot 157. The elongated pocket tab 158 may be fixed in place on the device surface 101 with an adhesive or tape, or if the material of the container is plastic, the tab 158 may be heat-sealed to the surface 101. This arrangement provides for a stronger attachment between tab 158 and surface 101.

The device is removably attached to the device surface 101 via the pockets 150 and the retaining straps 130.

The container 100 includes surface 102, which is the device support surface 102. In the first functional mode, this surface is parallel with the device surface 101 and forms one side of the container with device surface 101. In the second functional mode, this surface is at an angle with respect to the device surface 101 and acts to support the device during user operations.

The container 100 includes surface 103, which is the interface support surface 103. In the first functional mode, this surface is parallel with and adjacent to the device surface 101 and forms the other side of the container. In the second functional mode, this surface is at an angle with respect to the device surface 101 and abuts an external surface upon which the combination of the container 100 and the device rests during user operations. The external surface may be a portion of a piece of furniture, e.g. a table, or other object, e.g. the user's lap or hand, upon which the user is going to be operating the device. Alternatively, in the second functional mode, the surface 103 may be rotated completely around surface 101, until both surfaces are parallel with each other and adjacent to each other, and the device is accessible by the user.

The container 100 also includes surface 104, which is the device bottom surface 104. In the first functional mode, this surface is substantially perpendicular with the device surface 101 and forms the bottom side of the container. In this mode, this surface is adjacent to the top of the device. In the second functional mode, this surface is at an angle with respect to the device surface 101 and surface is at an angle with respect to the device surface 101 and acts to support the device in during user operations.

The interface support surface 103 includes handle 110. The handle 110 includes optional handle flap 113 and optional handle space 116. As shown, the handle flap 113 is formed by making a cut into interface support surface 103 that removes material to form a cavity. In the first functional mode, the handle 110 combines with stand handle 111 to form a container handle that allows the container to be transported. In this mode, the handle flap 113 is folded through the cavity in the stand handle and around the stand handle. The handle space 116 should be sized to at least twice the thickness of the material, so that both handles can be held together. In the second functional mode, the handle 110 acts as part of the interface support surface 103.

The device surface 101 includes stand handle 111. In the first functional mode, the stand handle 111 combines with handle 110 to form a container handle that allows the container to be transported. In the second functional mode, the stand handle 111 is passed through one of the stand slots 112*n* in interfaced support surface 103. This acts to lock the container in a stand orientation and allows the device to be operated by a user. In FIG. 1, the container has two stand slots 112*a*, 112*b*, however, other embodiments can have a different number of stand slots, e.g. one stand slot, or three or more stand slots. Also as shown in FIG. 1, the stand slots 112*n* are cuts in the surface 103. However, the stand slots may also be formed by cutting an removing material to form cavities into which the stand handle 111 is placed.

Figure 4A:
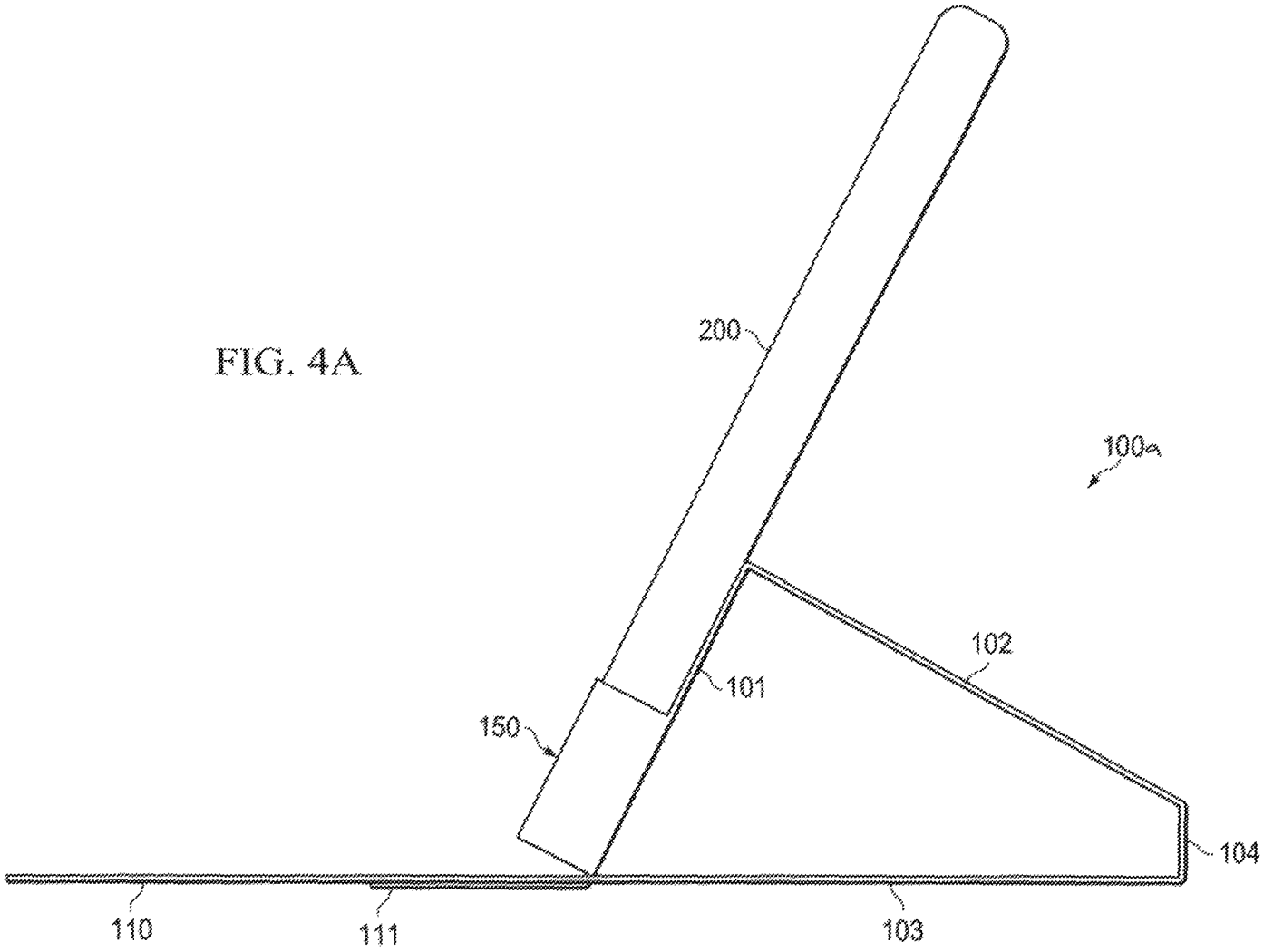
FIGS. 4A-4C depict the container of FIG. 1 in the second arrangement or stand mode, and the first arrangement or transport mode.
Figure 4B:
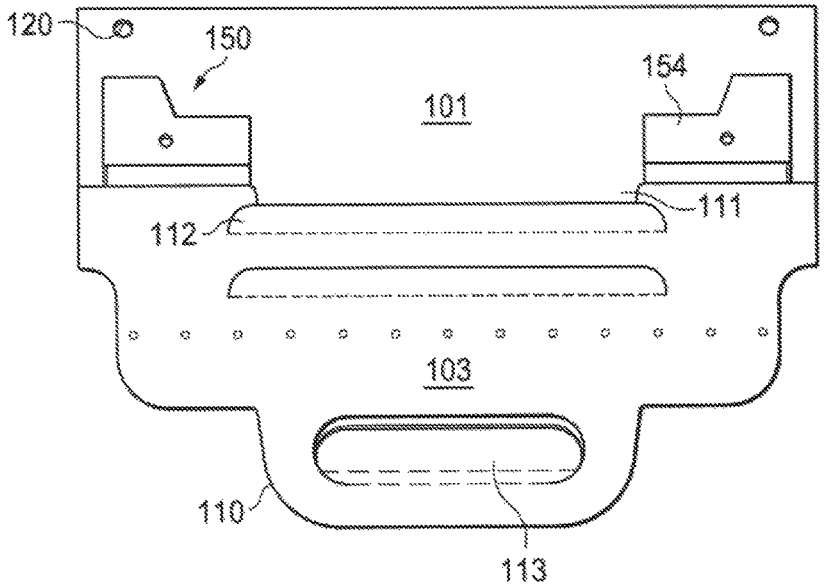
Figure 4C:
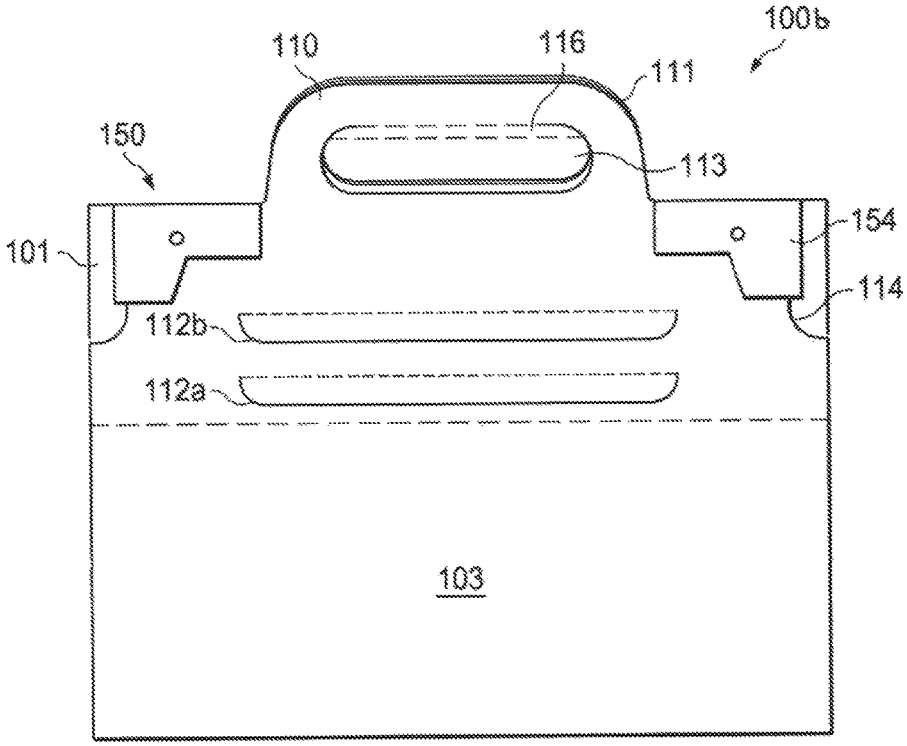

FIGS. 4A and 4B depict the container 100*a* in the second functional mode. FIG. 4A depicts a side elevation view of the container 100*a* with a device 200. Note for simplicity the straps 130 are not shown. FIG. 4B depicts a front elevation view of the container 100*a*. Note for simplicity the straps 130 and the device 200 are not shown. FIG. 4C depicts the container 100*b* in the first functional mode. FIG. 4C depicts a top view of the container of FIG. 1 closed and ready for transport. The interface support surface 103 is tucked into the pockets 150. The handle 110 is proximate with the stand handle 111. The handle flap 113 is ready to be wrapped through the cavity of the handle 110 and the stand handle 111, and then around the stand handle 111. To open the container, a user would push downward, away from the handle 110, on the thumb notches 114. This would slide the portions of surface 103 tucked into the pockets out of the pockets. The surface 103 can then be opened from the device.

The container 100 of FIG. 1 may optionally includes thumb notches 114 on surface 103 and/or one or more tucking folds 115*a* and 115*b*. In the first functional mode, the interface support surface 103 may tuck into the pocket(s) 150. Specifically, the portion 170 of the surface 103 would fit in to the pocket 150. This would keep the container closed for transport of the device. To assist in opening the container, the user would push on thumb notches 114 to slip release the surface 103 from the pocket(s) 150. The tucking fold(s) 115*a* and 115*b* would allow the surface 103 to flex during opening and closing. The tucking folds are particularly needed if the container is made from a ridged material, such as polypropylene or thick cardboard.

Figure 5:
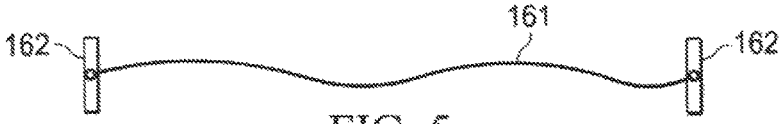
FIG. 5 depicts an optional closure strap for the container of FIG. 1.

If surface 103 does not tuck into the pocket(s) 150 to close the container 100, then the container 100 of FIG. 1 may optionally include a closure strap 161 of FIG. 5. The strap 161 has ends 162 that are fitted into holes 160*a* located in the pocket outer front surface 154. The holes 160*b* may also be located in pocket flap 151 and pocket outside surface 153. The holes in 151 and 153 are placed to line up when folded. Alternatively, there may be a single hole 160*c* used by the closure strap 161. In this case, the closure strap would resemble retaining strap 130. The closure strap 161 is used in the first functional mode to hold surface 101/102 closed with surface 103.

Figure 6:
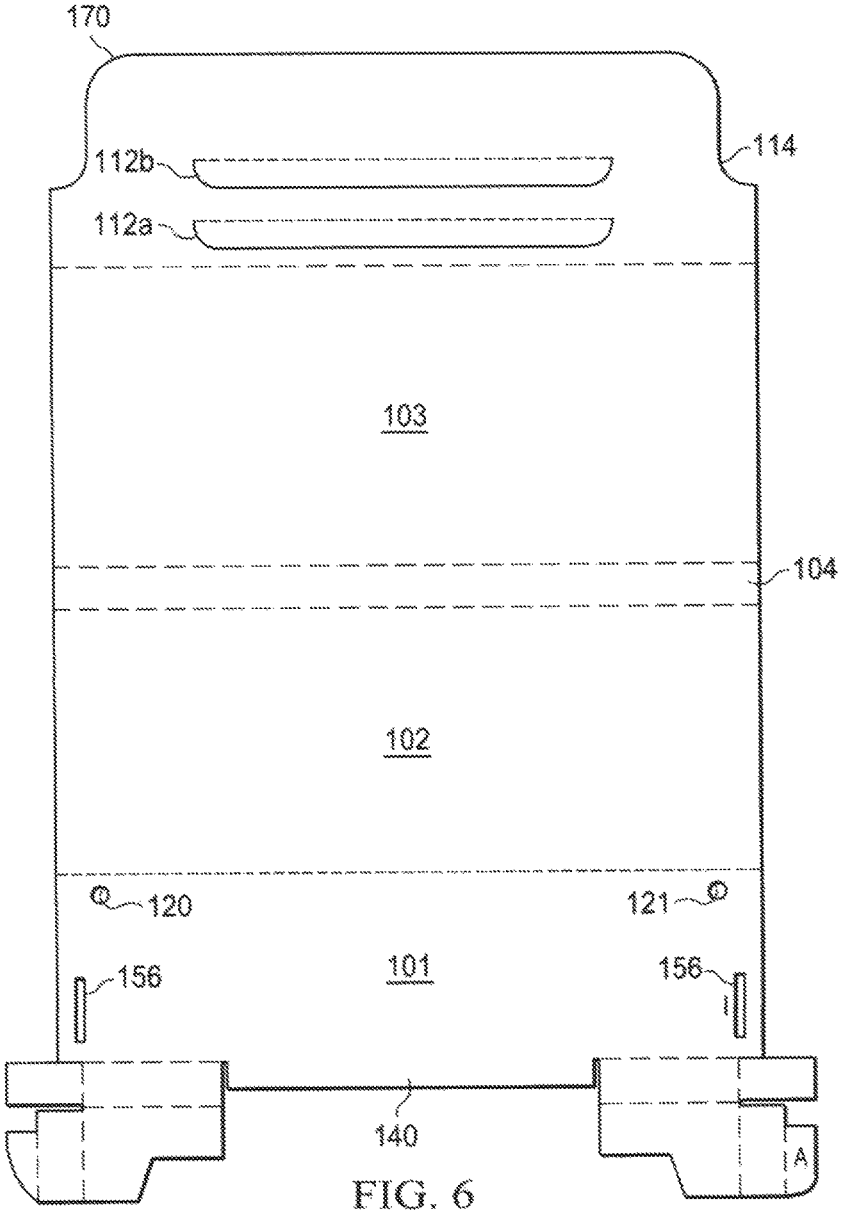
FIG. 6 depicts another example of the container and stand for a device that does not include handles.

FIG. 6 depicts another example of the container and stand for a device that does not include handles. This arrangement uses a stand flap 140 instead of stand handle 111. The stand flap 140 is inserted into the stand slot 112*n*.

Figure 7:
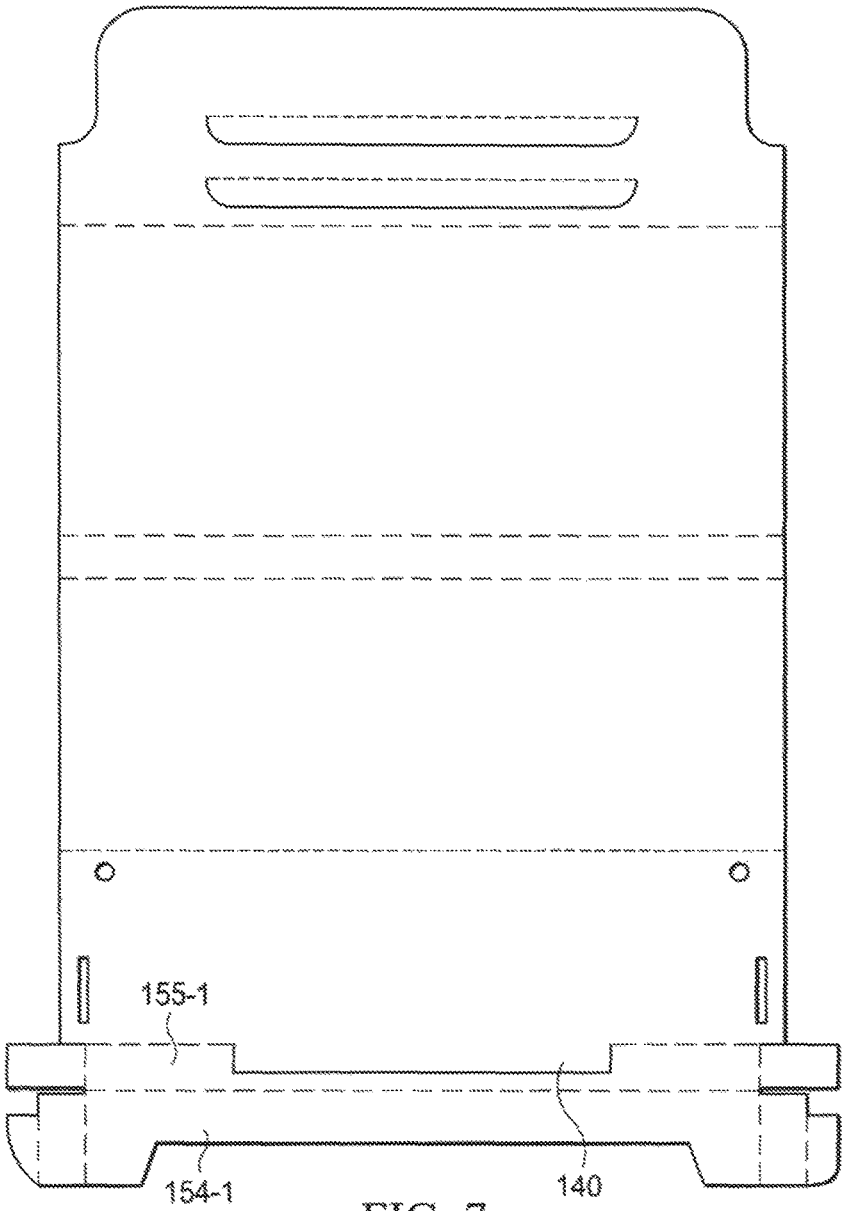
FIG. 7 depicts another example of the container and stand for a device that uses one pocket.

FIG. 7 depicts another example of the container of FIG. 6 that uses a single pocket. This container is similar to that of FIGS. 1 and 6 and has one pocket outer front surface 154-1 and one pocket outer bottom surface 155-1. The stand flap 140 is cut from surface 155-1. When folded as described with respect to FIG. 1, this forms one pocket that extends the width of the container. As another alternative, only surface 154 may extend across the width of the container.

Figure 8A:
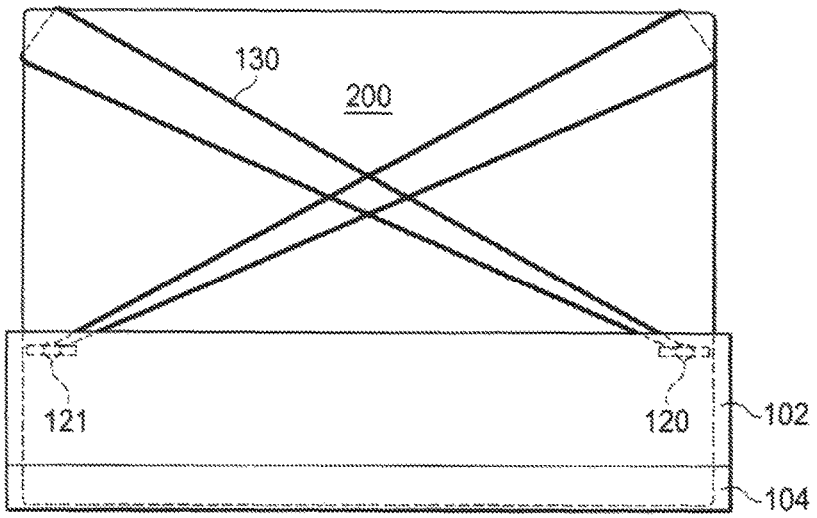
FIGS. 8A and 8B depict an example of the container having the device in landscape mode and portrait mode, respectively.

The container of FIG. 7 allows for the device to be used either in portrait mode or landscape mode. In comparison, the container of FIG. 1 allows the device to be used in landscape mode, i.e. with the widest side of the device arranged in a horizontal manner. In landscape mode, the retaining straps 130 would be arranged as described in FIG. 1, namely crossed along the back of the device. FIG. 8A depicts an arrangement having the device in landscape mode. In the portrait mode, i.e. with the widest side of the device arranged in vertical manner, the retaining straps 130 would not cross along the back of the device. The first strap being passed through the first retaining strap hole 120 and looped around the same-side, upper corner of the device. More specifically, with hole 120 located on the left side of the container, the strap 130 passing through hole 120 would loop around the left upper corner of the device. The second strap being passed through the second retaining strap hole 121 and looped around an same-side, upper corner of the device. More specifically, with hole 121 located on the right side of the container, the strap 130 passing through hole 121 would loop around the right upper corner of the device. FIG.

Figure 8B:
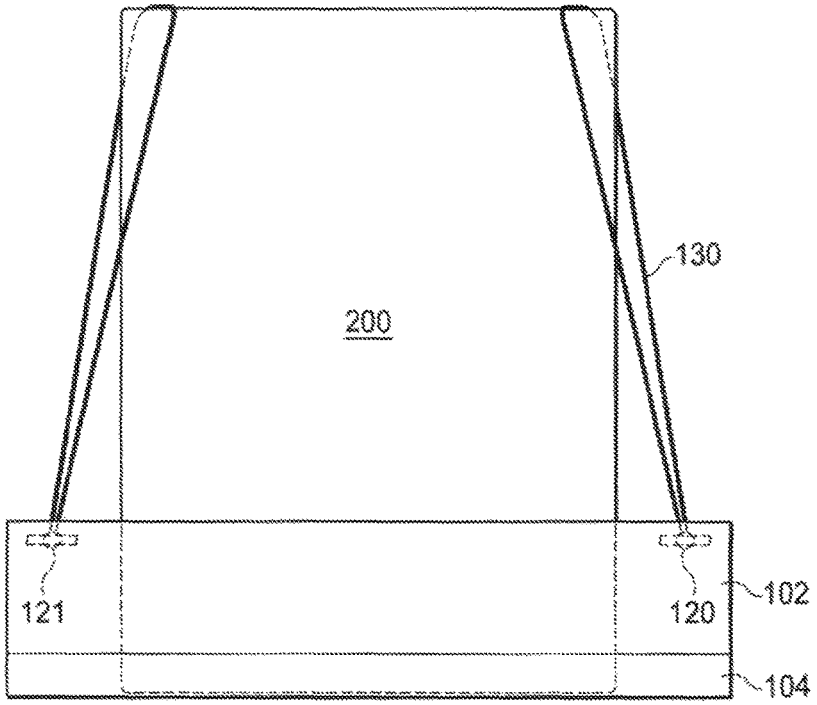

8B depicts an arrangement having the device in portrait mode. Note that the arrangements of FIGS. 8A and 8B are by way of example only, as the looping arrangements could be reversed. Furthermore, sets of different length straps could be used, with a shorter set for the landscape arrangement and longer set for the portrait arrangement.

Figure 9:
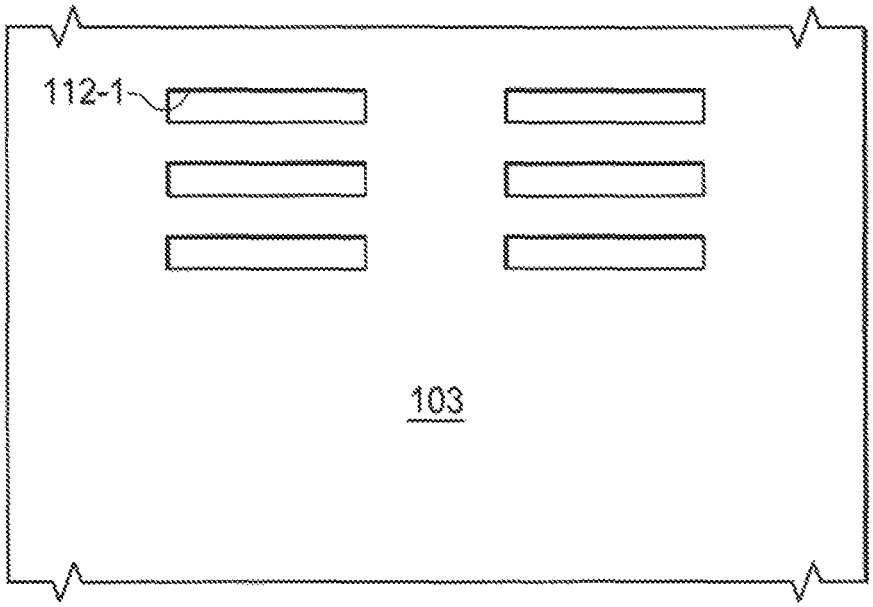
FIG. 9 depicts an alternative arrangement for the stand slots of the container of FIG. 6 or 7.

FIG. 9 depicts an alternative arrangement for the stand slots 112-1 for the container of FIG. 6 or 7. In this figure, each slot is broken into two portions. The stand flap 140 would similarly have two portions. Note that other arrangements could have more portions, e.g. three portions for each slot and stand flap.

Note that additional holes or ports may need to be made in the container to allow for access to controls and/or interface for a particular device.

As used herein, the words "comprise," "have," "include," and all grammatical variations thereof are each intended to have an open, non-limiting meaning that does not exclude additional elements or steps.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated that the conception and specific embodiment disclosed may be readily utilized as a basis for modifying or designing other structures for carrying out the same purposes of the present invention. It should also be realized that such equivalent constructions do not depart from the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

What is claimed is:

1. A container that has two arrangements, wherein in a first arrangement, the container holds a portable device for transport, and wherein a second arrangement, the container supports the portable device in two positions for use of the device, a landscape mode and a portrait mode, the container comprises:

a first pocket that holds a first corner of the device;

a second pocket that holds a second corner of the device;

a first retaining strap that holds one of a third corner of the device and a fourth corner of the device;

a second retaining strap that holds the other of the fourth corner of the device and the third corner of the device;

a device surface that adjoins the device and holds the device in the two arrangements, wherein the device surface is connected to the first pocket, the second pocket, the first retaining strap, and the second retaining strap;

a device support surface that adjoins the device surface at a fold, wherein the device support surface is parallel to the device surface in the first arrangement, and wherein the device support surface is at a nonzero angle with the device surface in the second arrangement;

an interface support surface that is adjacent to the device support surface, wherein the device support surface is parallel to the device surface in the first arrangement, and wherein the interface support surface is at a nonzero angle with the device surface in the second arrangement;

wherein the device surface, the device support surface and the interface surface form a polygon in one view of the second arrangement; and wherein the container is formed from a corrugated material having a plurality of corrugations, and wherein the fold is parallel with a direction of the corrugations of the corrugated material wherein the first and second pockets each comprise:

a pocket front surface;

a pocket side surface;

a pocket bottom surface;

wherein the pocket front surface, pocket side surface, and pocket bottom surface are placed proximate with each other to form a cavity of the pocket to hold a respective corner of the device;

a pocket tab that is adjacent to the pocket side surface; and a pocket slot that is located on the device surface; wherein the pocket tab and the pocket slot operate to maintain the pocket front surface, the pocket side surface, and the pocket bottom surface proximate with each other wherein a landscape mode of the device, the first retaining strap holds the third corner of the device, and the second retaining strap holds the fourth corner of the device, and the third corner of the device is diagonal from the first corner of the device; and wherein a portrait mode of the device, the first retaining strap holds the fourth corner of the device, and the second retaining strap holds the third corner of the device, and the third corner of the device is diagonal from the first corner of the device.

2. The container of claim 1, wherein the device surface comprises a stand handle; wherein the stand handle is used to carry the container in the first arrangement, and wherein the stand handle is inserted into a stand slot that is located in the interface support surface in the second arrangement.

3. The container of claim 2, wherein there are a plurality of stand slots, with each slot allowing the device surface to have a different angle with respect to the interface support surface.

4. The container of claim 1, wherein the device surface comprises a stand flap that is inserted into a stand slot that is located in the interface support surface in the second arrangement.

5. The container of claim 1, wherein the container is formed from biodegradable materials.

6. The container of claim 1, wherein the container is formed from recycled materials.

7. The container of claim 6, wherein the container is formed from packaging materials of the device.

8. The container of claim 6, wherein the container is formed from one of cardboard and polypropylene plastic.

9. The container of claim 1, wherein the device is an electronic device.

* * * * *